US008210909B2

(12) United States Patent
Bernardi et al.

(10) Patent No.: US 8,210,909 B2
(45) Date of Patent: Jul. 3, 2012

(54) ABRADING SYSTEM

(75) Inventors: Walter Bernardi, Highland Park, IL (US); Jie Liu, Lisle, IL (US)

(73) Assignee: Robert Bosch GmbH, Stuttgart (DE)

( * ) Notice: Subject to any disclaimer, the term of this patent is extended or adjusted under 35 U.S.C. 154(b) by 981 days.

(21) Appl. No.: 12/079,007

(22) Filed: Mar. 24, 2008

(65) Prior Publication Data

US 2009/0239455 A1 Sep. 24, 2009

(51) Int. Cl.
*B24B 23/04* (2006.01)

(52) U.S. Cl. ..... 451/495; 451/356

(58) Field of Classification Search ..... 451/357, 451/358, 359, 495, 526, 354, 356
See application file for complete search history.

(56) References Cited

U.S. PATENT DOCUMENTS

| | | | | |
|---|---|---|---|---|
| 3,522,681 | A | 8/1970 | Lampert | |
| 3,557,496 | A | 1/1971 | Martin | |
| 4,688,356 | A | 8/1987 | Madzgalla | |
| 4,802,310 | A | 2/1989 | Holmes | |
| 5,168,663 | A | 12/1992 | Klocke | |
| 5,309,681 | A | 5/1994 | Cheney et al. | |
| 5,593,340 | A * | 1/1997 | Nelson et al. | 451/42 |
| 5,662,519 | A | 9/1997 | Arnold | |
| 5,700,187 | A * | 12/1997 | Balbi | 451/495 |
| 6,042,462 | A | 3/2000 | Baratti | |
| 6,685,547 | B2 * | 2/2004 | Boman | 451/495 |
| 7,048,618 | B1 | 5/2006 | Cramer | |
| 7,553,221 | B2 * | 6/2009 | Hope et al. | 451/495 |
| 2002/0086627 | A1 | 7/2002 | Andrews et al. | |

FOREIGN PATENT DOCUMENTS

| | | |
|---|---|---|
| DE | 212323 | 7/1909 |
| DE | 19544465 | 6/1997 |

OTHER PUBLICATIONS

International Search Report in corresponding PCT application (i.e. PCT/US2009/036836) mailed Sep. 10, 2009 (5 pages).

* cited by examiner

*Primary Examiner* — Timothy V Eley
(74) *Attorney, Agent, or Firm* — Maginot, Moore & Beck

(57) ABSTRACT

The present invention is an abrading system for a hand power tool including a base with a first end portion and a second end portion and configured to couple with the output shaft of a hand power tool, a flexible substrate having a first extending portion coupled with the first end portion and extending outwardly from the first end portion, a second extending portion coupled with the second end portion and extending outwardly from the second end portion, and a middle portion spaced apart from the base and extending between the first extending portion and the second extending portion, and an abrading material attached to the flexible substrate.

17 Claims, 5 Drawing Sheets

ABRADING SYSTEM

FIELD OF THE INVENTION

The present invention relates to hand tools and more particularly to an accessory for abrading contoured work pieces.

BACKGROUND

Hand held power tools are widely used by many people including professionals, craftspeople, homeowners, and artists. These power tools typically include an outer housing designed to be easily held within human hands. The housing retains an electric motor which is operable to drive a chuck of the power tool. The movements provided by various power tools include reciprocating, rotating, and orbiting patterns. The movement provided with a particular tool is dependent upon the purpose of the tool.

One purpose for which power tools may be used is the abrading of contoured surfaces. Abrading tools typically include rotating devices such as drum sanders, belt sanders, and disc sanders and orbital devices such as random orbit sanders. Each type of sander provides different benefits and limitations for different abrading tasks. For example, drum sanders are very effective for use in abrading interior curves of a work piece. While drum sanders may be used for external curves, care must be taken to avoid altering the contour of the work-piece since the shape of the abrading surface is not complementary to the shape of the work piece.

Disc sanders and orbiting sanders may also be used to abrade external curves of a work piece. The abrading surface of prior art disc sanders and orbiting sanders, however, is substantially flat. Thus, while these types of sanders are generally more controllable than drum sanders, non-conformance with the shape of the work piece results in a relatively small contact area between the abrading surface and the work piece. A small contact area focuses the effect of the abrading device on a localized area of the work piece. Thus, the contour of the work piece may be inadvertently altered.

Additionally, as the surface contact area of the abrading material is reduced, the abrading material becomes more susceptible to localized failure. Thus, an abrading sheet attached to an orbital sander may rip at the location of the abrading material which is in contact with the work piece. While the damaged area may be quite small, the entire abrading sheet may be rendered unusable.

A number of specialized accessories have been developed to assist in abrading work pieces with various contours. These accessories, however, tend to be relatively expensive. Additionally, specialized contouring devices are typically specifically designed for contours of a particular shape and size. Thus, a large number of the accessories must be maintained to allow for abrading contours of different shapes and sizes.

Other devices which may be used to abrade contoured work pieces use a resilient pad placed over a sanding plate. While the use of a pad increases the surface area of the abrading material in contact with the work piece, pads conform to only slight contours. Accordingly, contour abrading is frequently still done by hand using a piece of sand paper.

Therefore, a contour abrading device that may be used with an orbital sander that conforms the abrading material to a variety of contours would be beneficial.

SUMMARY

The present invention is an abrading system for a hand power tool including a base with a first end portion and a second end portion and configured to couple with the output shaft of a hand power tool, a flexible substrate having a first extending portion coupled with the first end portion and extending outwardly from the first end portion, a second extending portion coupled with the second end portion and extending outwardly from the second end portion, and a middle portion spaced apart from the base and extending between the first extending portion and the second extending portion, and an abrading material attached to the flexible substrate.

In one embodiment an abrading kit for use with a hand power tool includes at least one base with a first end portion and a second end portion and configured to couple with the output shaft of a hand power tool, and a plurality of flexible substrates, each of the plurality of flexible substrates having (i) a first extending portion for coupling with the first end portion so as to extend outwardly from the first end portion, (ii) a second extending portion for coupling with the second end portion so as to extend outwardly from the second end portion, and (iii) a middle portion extending between the first extending portion and the second extending portion and configured to couple with at least one abrading sheet, each of the plurality of flexible substrates having a flexibility different from the flexibility of the other of the plurality of flexible substrates.

In a further embodiment, an abrading system for a hand power tool includes a base with a first base end portion and a second base end portion and configured to couple with the output shaft of a hand power tool, the base defining a base length between a first coupler at the first base end portion and a first coupler at the base second end portion, a flexible substrate having a first substrate end portion coupled with the first base end portion, a second substrate end portion coupled with the second base end portion, and a middle portion extending between the first extending portion and the second extending portion, the flexible substrate defining a working length wherein the working length is greater than the base length, and an abrading material attached to the flexible substrate.

These and other advantages and features of the present invention may be discerned from reviewing the accompanying drawings and the detailed description of the preferred embodiment of the invention.

BRIEF DESCRIPTION OF THE DRAWINGS

The present invention may take form in various system and method components and arrangement of system and method components. The drawings are only for purposes of illustrating exemplary embodiments and are not to be construed as limiting the invention.

DESCRIPTION

Figure 1:
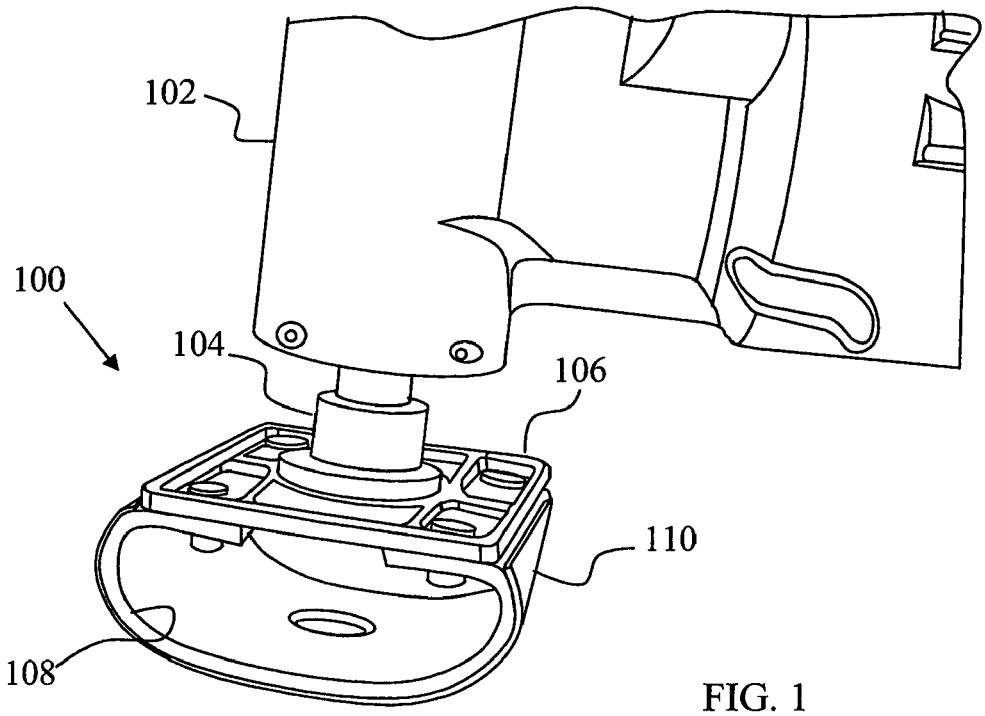
FIG. 1 depicts a top perspective view of a contour abrading device coupled with a hand-held power tool in accordance with principles of the invention.

Referring to FIG. 1, a contour abrading device 100 is shown mounted to a hand-held power tool 102. The hand-held power tool 102 in this embodiment is a random orbit device, although other devices may be used to provide movement for the contour abrading device 100. The contour abrading device 100 is removably mounted to the hand-held power tool 102 by a mandrel assembly 104. Alternatively, a contour abrading device may be provided with an integral mandrel for coupling with a power tool that includes a collet assembly.

Figure 2:
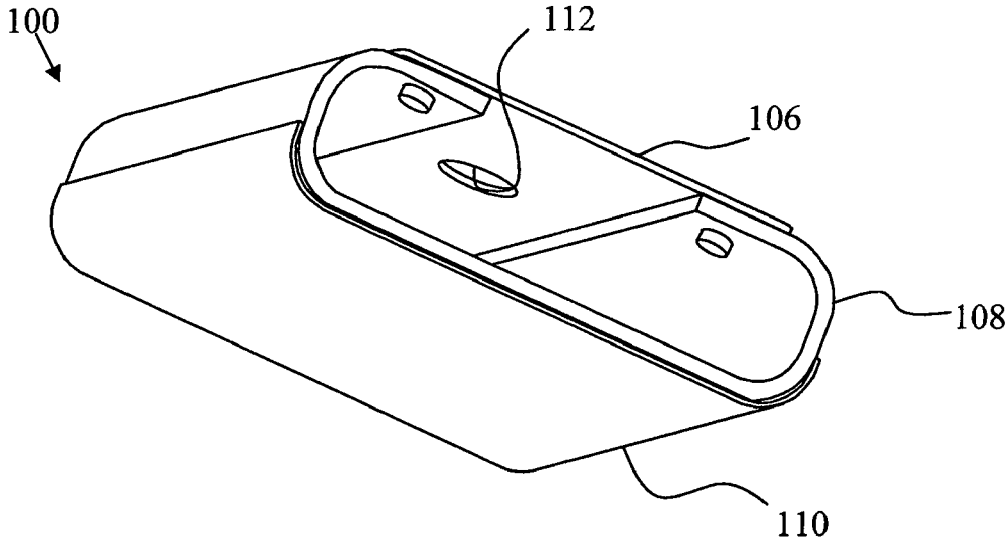
FIG. 2 depicts a bottom perspective view of the contour abrading device of FIG. 1.
Figure 3:
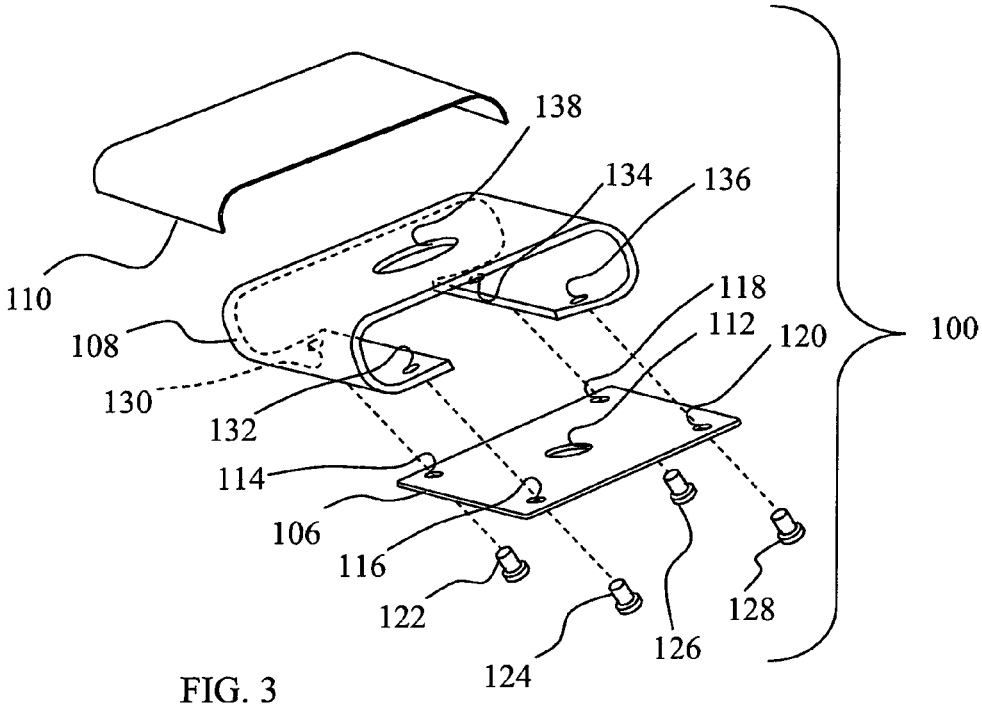
FIG. 3 depicts an exploded perspective view of the contour abrading device of FIG. 1.
Figure 4:
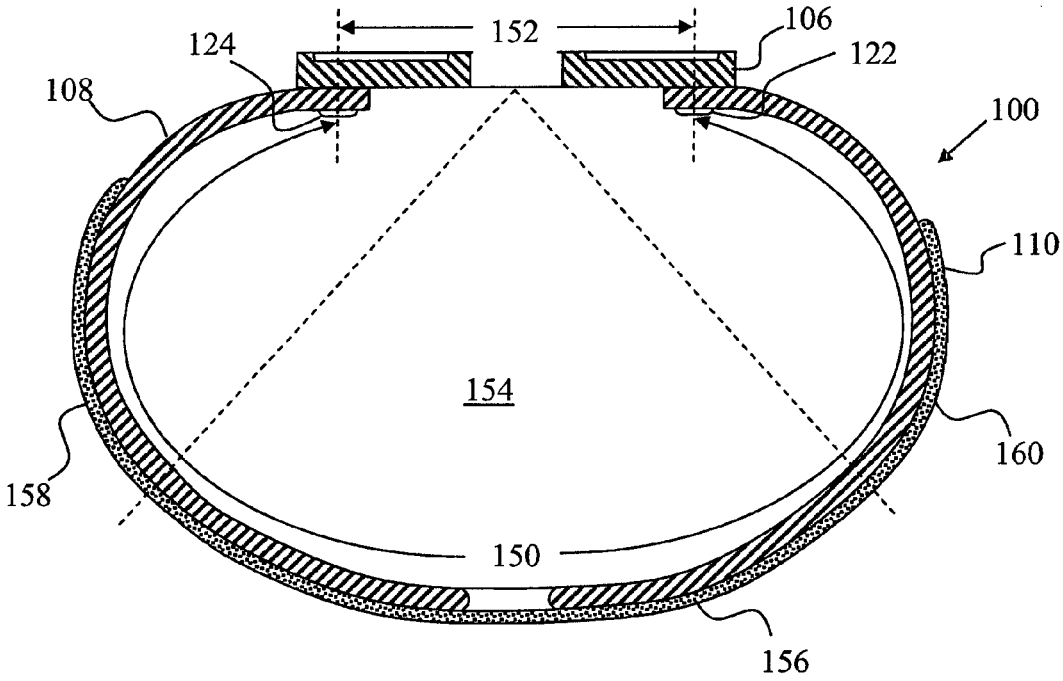
FIG. 4 depicts a cross-sectional view of the contour abrading device of FIG. 1 showing the working length and base length of the device and identifying a primary abrading surface and two secondary abrading surfaces

With reference to FIGS. 2-4, the contour abrading device 100 includes a base 106, a flexible substrate 108 and an abrading sheet 110. The base 106 includes a coupling feature 112 for use in mounting the contour abrading device 100 with the power tool 102, although other coupling members could be used. The base 106 further includes four holes 114, 116, 118, and 120 which receive four rivets 122, 124, 126, and 128.

The four rivets 122, 124, 126, and 128 extend from the base 106 through four holes 130, 132, 134, and 136 in the flexible substrate 108. In alternative embodiments, the flexible substrate is removably attached to a base using, for example, screws or bolts. In another alternative, the substrate can be adhesive bonded on the base. In yet another alternative, the substrate can be insert molded thermoplastic elastomer over a thermoplastic base. The flexible substrate 108 includes an opening 138. The opening 138 is located at the center portion of the flexible substrate 108. The abrading sheet 110 is attached to the flexible substrate 108 using an adhesive. Other techniques for attaching an abrading sheet to a substrate may be used including hook and loop techniques.

As shown in FIG. 4, the flexible substrate 108 has a working length 150 that is larger than the base length 152. The working length 150 is the length of the flexible substrate 108 between the rivets 122, 124 and 126, 128. The base length 152 is the length of the base 106 between the rivets 122, 124 and 126, 128. Because the working length 150 is longer than the base length 152, a gap area 154 is formed between the base 106 and a primary abrading portion 156. Two secondary abrading portions 158 and 160 are formed adjacent to the primary abrading portion 156. While a work piece may be abraded using any portion of the abrading sheet 110, most abrading of contoured areas is performed using the primary abrading portion 156.

Figure 5:
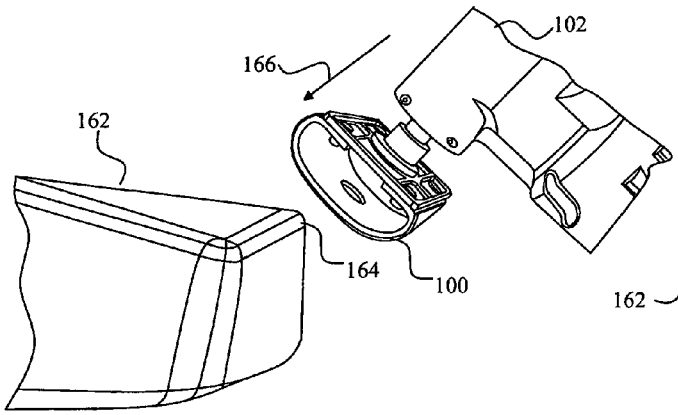
FIG. 5 depicts the contour abrading device and power tool of FIG. 1 positioned above a work piece with a contoured surface.
Figure 6:
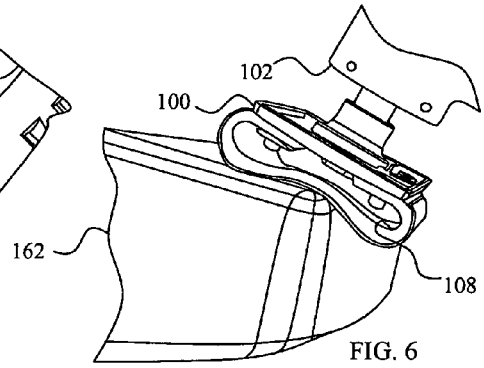
FIG. 6 depicts the contour abrading device and power tool of FIG. 1 pressed against the contoured surface of the work piece of FIG. 5 with the contour abrading device deformed to conform to the shape of the contoured surface.

For example, the work piece 162 of FIG. 5, which includes a contoured portion 164, may be abraded by positioning the primary abrading portion 156 of the contour abrading device 100 above the contoured portion 164 and energizing the power tool 102. Positioning the primary abrading portion 156 against the work piece 162 and applying pressure in the direction of the arrow 166 causes the flexible substrate 108 to deform, thereby conforming to the shape of the work piece 162 as shown in FIG. 6.

The extent to which the contour abrading device 100 conforms to the contour of a work piece is a function of the force with which the contour abrading device 100 is held against the work piece, the physical characteristics of the particular material used to form the flexible substrate 108 and the mismatch between the working length 150 and the base length 152. For a given applied force, increasing the mismatch allows more conformity as does increasing the flexibility of the substrate. One group of materials which may be used as a flexible substrate material to provide elasticity and strength are TPEs (thermoplastic elastomers).

Figure 7:
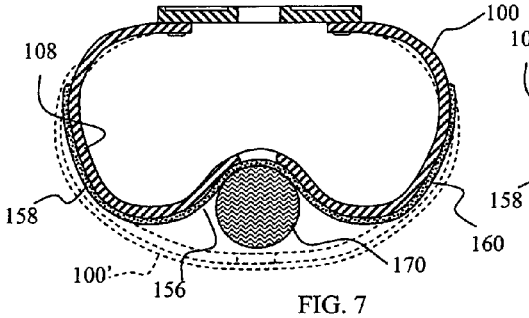
FIG. 7 depicts a cross-sectional view of the contour abrading device of FIG. 1 deformed to conform to the shape of a round work piece.

The mismatch between the working length 150 and the base length 152 contributes to the flexibility of the flexible substrate 108 and allows the contour abrading device 100 to conform to work pieces exhibiting a variety of contours. By way of example, the work piece 170 of FIG. 7 is a circular work piece. The contour abrading device 100, which is not shown connected to a power tool, has been deformed from the original shape of the contour abrading device 100' by forcing the contour abrading device 100 against the work piece 170. The curvature of the flexible substrate 108 in the secondary abrading portions 158 and 160 provides even pressure across the primary abrading portion 156 which conforms to the work piece 170 over a substantial area of the curved surface of the work piece 170.

Figure 8:
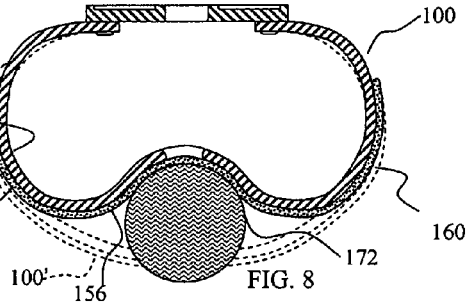
FIG. 8 depicts a cross-sectional view of the contour abrading device of FIG. 1 deformed to conform to the shape of a round work piece that has a radius of curvature larger than the radius of curvature of the work piece of FIG. 7.

The work piece 172 of FIG. 8 is a circular work piece that has a radius that is larger than the radius of the work piece 170. Nonetheless, the contour abrading device 100, which is not shown connected to a power tool, has been deformed from the original shape of the contour abrading device 100' to conform to the larger radius of the work piece 172. This is possible since the flexible substrate 108 can be forced into different configurations in the secondary abrading portions 158 and 160 to provide even pressure across the primary abrading portion 156 for contours having a variety of radii.

While the contour abrading device 100 may be used for a variety of contours, increasing the contact area between the contoured surface of a work piece and the abrading sheet generally requires increased pressure on the particular contour abrading device so as to increase the deformation of the flexible substrate. The abrading device may be modified in various ways, however, to mitigate the amount of force that is required. If desired, a kit may be provided with flexible substrates made of different materials, each of the materials exhibiting different elasticities. Alternatively, a single material may be used to provide different flexibility.

By way of example, the top hole 138 (see FIG. 3) results in a reduced amount of material in the flexible substrate 108 at the central portion of the primary abrading portion 156. Accordingly, the resistance to deformation of the flexible substrate 108 at the central portion of the primary abrading portion 156 is less than the resistance to deformation of the secondary abrading portions 158 and 160. Thus, selective patterning of material may be used to modify the operating characteristics of different contour abrading devices.

Figure 9:
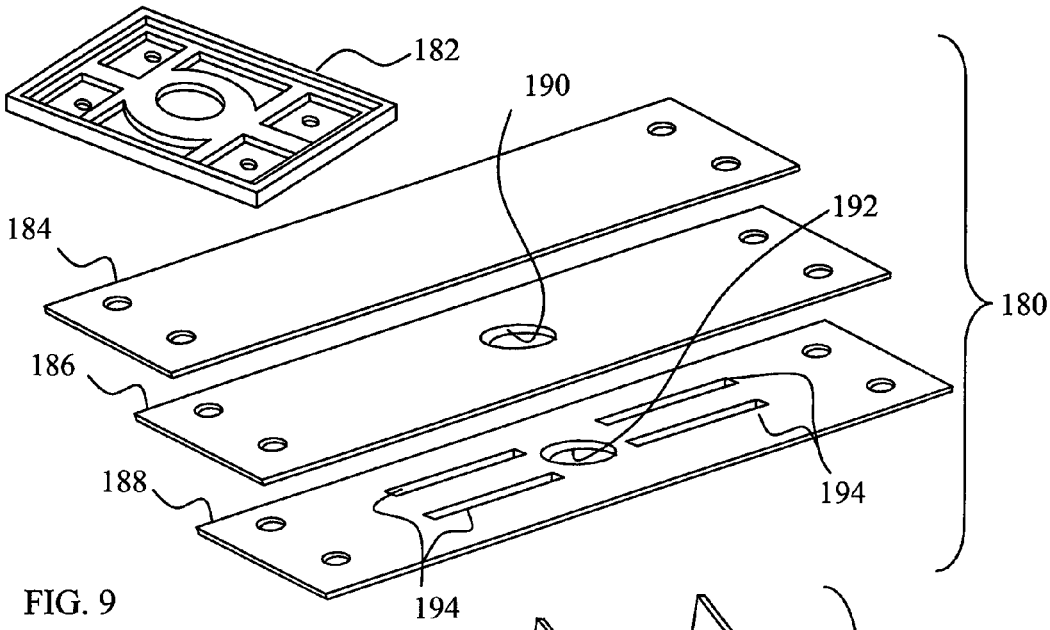
FIG. 9 depicts a kit including a base and three flexible substrates that can be removably coupled to the base wherein the flexible substrates are patterned such that each of the flexible substrates has a flexibility different from the flexibility of the other flexible substrates.

The kit 180 of FIG. 9 incorporates selective patterning to provide a variety of operating characteristics for the contour abrading system. The kit 180 includes a base 182 and three flexible substrates 184, 186, and 188. The substrates 184, 186, and 188 include a surface configured for hook and loop coupling with an abrading sheet (not shown). Abrading sheets, along with couplers for removably attaching the flexible substrates 184, 186, and 188 to the base 182, may be provided in the kit 180. The ability to removably couple abrading sheets using hook and loop coupling enables each of the three flexible substrates 184, 186, and 188 to be used with a variety of abrading sheets.

Each of the flexible substrates 184, 186, and 188 provide a different rigidity. The flexible substrate 184 is the most rigid of the three substrates and may be used on contoured surfaces with a relatively large radius of curvature. The flexible substrate 186 is patterned with an opening 190. Accordingly, the flexible substrate 186 is less rigid than the flexible substrate 184. The flexible substrate 186 is thus configured for use on contoured surfaces with radii of curvature smaller than those associated with the flexible substrate 184. Alternatively, using the flexible substrate 186 on work pieces having larger radii of curvature allows for more surface area of the work pieces to be contacted with an abrading material with less application of force.

The flexible substrate 188 includes an opening 192 along with four slits 194. Thus, the flexible substrate 192 is less rigid than the flexible substrate 186. The flexible substrate 188 is thus configured for use on contoured surfaces with radii of curvature smaller than those associated with the flexible substrate 186. Alternatively, using the flexible substrate 188 on work pieces having larger radii of curvature allows for more surface area of the work pieces to be contacted with an abrading material with less application of force. Additional flexible substrates with different patterns may be included in the kit 180. In alternative embodiments, each flexible substrate is provided with a dedicated base.

Figure 10:
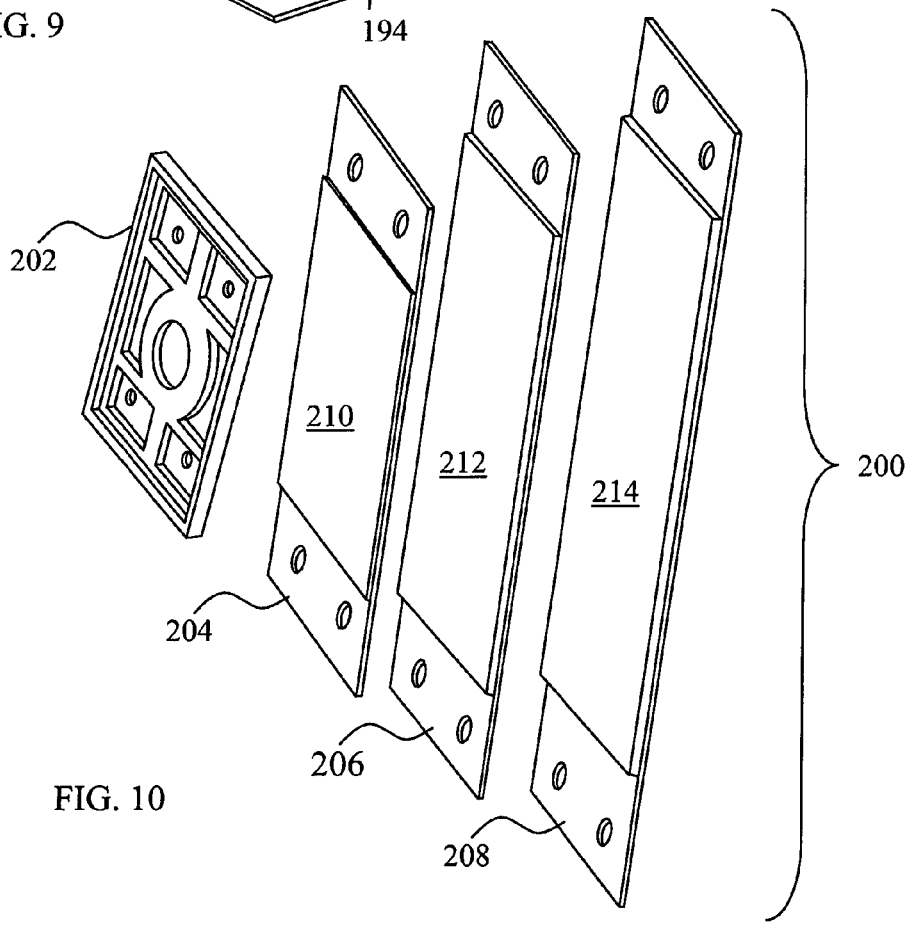
FIG. 10 depicts a kit including a base and three flexible substrates that can be removably coupled to the base wherein the flexible substrates are provided with different working lengths such that each of the flexible substrates has a flexibility different from the flexibility of the other flexible substrates.

Different operating characteristics may also be provided by modifying the mismatch between the working length and the base length of different contour abrading devices. Specifically, as the mismatch between the working length and the base length increases, less force is required to conform the respective contour abrading devices to abrade a give surface area of a work piece. By way of example, the kit 200 of FIG. 10 includes a base 202 and three removable flexible substrates 204, 206, and 208. In this embodiment, each of the flexible substrates 204, 206, and 208 is provided with an abrading pad or sheet 210, 212, and 214, respectively.

Each of the flexible substrates 204, 206, and 208 provide a different rigidity. The flexible substrate 204 has the shortest working length and is the most rigid of the three substrates. The flexible substrate 206 has a working length that is longer than the working length of the flexible substrate 204. Accordingly, the flexible substrate 206 is less rigid than the flexible substrate 204 when attached to the base 202. The flexible substrate 208 has the longest working length of the three substrates. Thus, the flexible substrate 208 is less rigid than the flexible substrate 206 when attached to the base 202. Additional flexible substrates with different working lengths may be included in the kit 200.

Figure 11:
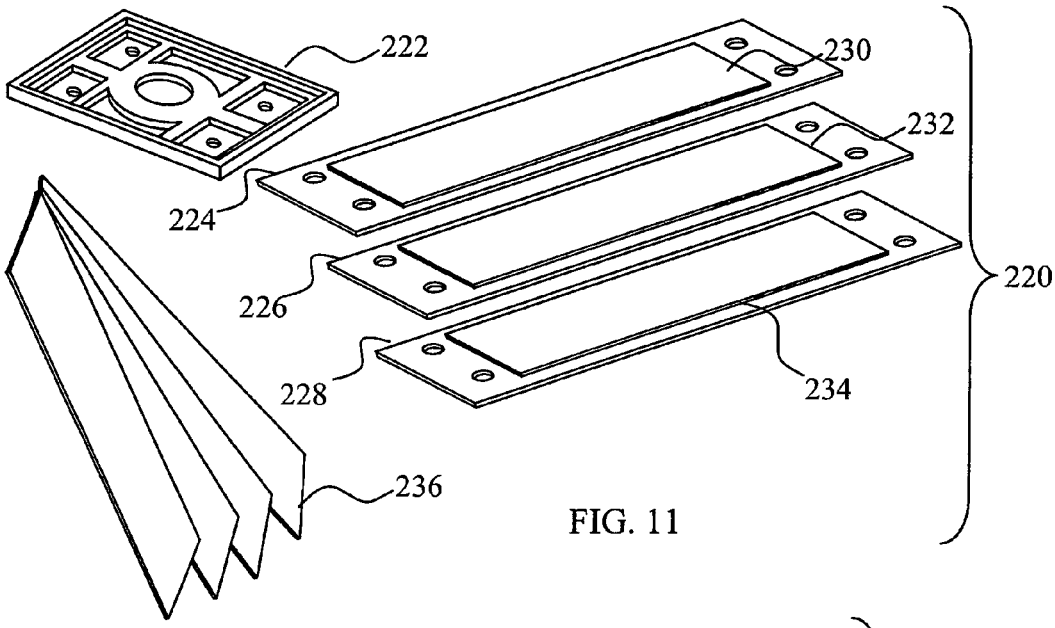
FIG. 11 depicts a kit including a base and three flexible substrates that can be removably coupled to the base wherein the flexible substrates are made from different materials such that each of the flexible substrates has a flexibility different from the flexibility of the other flexible substrates.

The kit 220 shown in FIG. 11 is a further embodiment. The kit 220 includes a base 222 and three removable flexible substrates 224, 226, and 228. In this embodiment, each of the flexible substrates 224, 226, and 228 is provided with a coupling feature such as a hook and loop coupling member 230, 232, and 234, respectively. The hook and loop coupling members 230, 232, and 234 are used to couple with one of a plurality of abrasive sheets 236 provided with the kit 220.

Each of the flexible substrates 224, 226, and 228 provide a different rigidity. The flexible substrates 224, 226, and 228 each have the same length and width. The difference in flexibility is achieved by forming each of the flexible substrates 224, 226, and 228 from a material that has a hardness different from the material used to form each of the other substrates. Accordingly, the flexible substrate 224 is less rigid than the flexible substrate 226, which is in turn less rigid than the flexible substrate 228.

Figure 12:
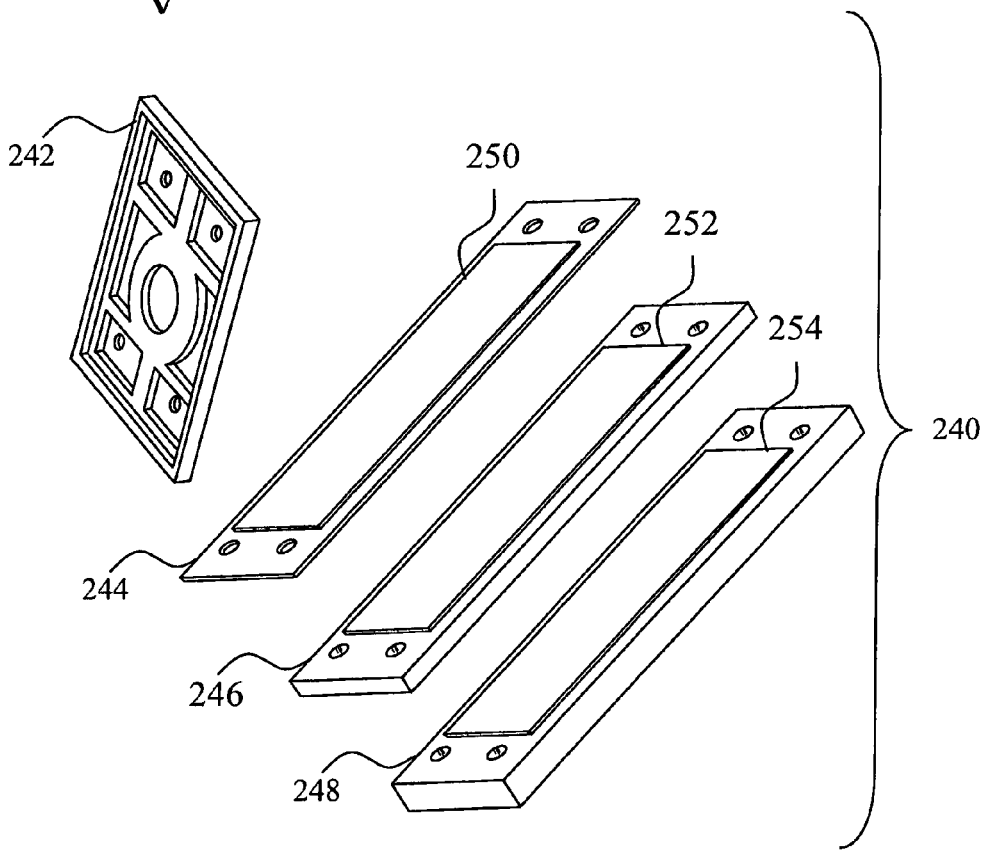
FIG. 12 depicts a kit including a base and three flexible substrates that can be removably coupled to the base wherein the flexible substrates are provided with different thicknesses such that each of the flexible substrates has a flexibility different from the flexibility of the other flexible substrates.

The kit 240 shown in FIG. 12 is a further embodiment. The kit 240 includes a base 242 and three removable flexible substrates 244, 246, and 248. in this embodiment, each of the flexible substrates 244, 246, and 248 is provided with an abrasive sheet 250, 252, and 254, respectively.

Each of the flexible substrates 244, 246, and 248 provide a different rigidity. The flexible substrates 244, 246, and 248 each have the same length and width. Additionally, the flexible substrates 244, 246, and 248 are formed from the same material. The difference in flexibility is achieved by forming each of the flexible substrates 224, 226, and 228 with a thickness different from the thickness of each of the other substrates. Accordingly, the flexible substrate 244 is less rigid than the flexible substrate 246, which is in turn less rigid than the flexible substrate 248.

While the present invention has been illustrated by the description of exemplary processes and system components, and while the various processes and components have been described in considerable detail, applicant does not intend to restrict or in any limit the scope of the appended claims to such detail. Additional advantages and modifications will also readily appear to those skilled in the art. The invention in its broadest aspects is therefore not limited to the specific details, implementations, or illustrative examples shown and described. Accordingly, departures may be made from such details without departing from the spirit or scope of applicant's general inventive concept.

The invention claimed is:

1. An abrading system for a hand power tool comprising:

a planar base substantially contained within a single plane, the planar base having a first end portion and a second end portion and configured to couple with the output shaft of a hand power tool;

a flexible substrate having a first extending portion directly coupled with the first end portion and extending outwardly from the first end portion, a second extending portion directly coupled with the second end portion and extending outwardly and downwardly from the second end portion, and a middle portion spaced apart from the base and extending between the first extending portion and the second extending portion; and an abrading material attached to the flexible substrate;

wherein the flexible substrate defines a continuous flexible member extending from the first extending portion to the second extending portion.

2. The system of claim 1, wherein the middle portion is patterned for providing a flexibility in the middle portion different from the flexibility of the first extending portion and the second extending portion.

3. The system of claim 1, wherein the abrading material comprises a sheet of abrading material removably attached to the flexible substrate.

4. The system of claim 3, wherein the abrading material is attached to the flexible substrate with a hook and loop configuration.

5. The system of claim 1, wherein the first extending portion is removably coupled with the first end portion and the second extending portion is removably coupled with the second end portion.

6. An abrading kit for use with a hand power tool comprising:

at least one planar base substantially contained within a single plane, the at least one planar base having with a first end portion and a second end portion and configured to couple with the output shaft of a hand power tool; and a plurality of flexible substrates, each of the plurality of flexible substrates having (i) a first extending portion for directly coupling with the first end portion so as to extend outwardly from the first end portion, (ii) a second extending portion for directly coupling with the second end portion so as to extend outwardly from the second end portion, and (iii) a middle portion spaced apart from the base and extending between the first extending portion and the second extending portion and configured to couple with at least one abrading sheet, each of the plurality of flexible substrates having a flexibility different from the flexibility of the other of the plurality of flexible substrates;

wherein the each of the flexible substrates in the plurality defines a continuous flexible member extending from the first extending portion to the second extending portion when directly coupled to the planar base.

7. The kit of claim 6, wherein the plurality of flexible substrates comprises:

a first flexible substrate with a first length; and a second flexible substrate with a second length.

8. The kit of claim 6 wherein the plurality of flexible substrates comprises:

a first flexible substrate; and a second flexible substrate, the second flexible substrate patterned such that the second flexible substrate is more flexible than the first flexible substrate.

9. The kit of claim 6 wherein the plurality of flexible substrates comprises:

a first flexible substrate formed from a first material having a first hardness; and a second flexible substrate formed from a second material having a second hardness, the second hardness harder than the first hardness.

10. The kit of claim 6 wherein the plurality of flexible substrates comprises:

a first flexible substrate having a first thickness; and a second flexible substrate having a second thickness, the second thickness thicker than the first thickness.

11. The kit of claim 6, wherein the at least one base comprises a plurality of bases, each of the plurality of bases fixedly coupled with a respective one of the plurality of flexible substrates.

12. The kit of claim 6, further comprising a plurality of abrading sheets, each of the plurality of abrading sheets fixedly coupled with a respective one of the plurality of flexible substrates.

13. The kit of claim 6, further comprising a plurality of abrading sheets, each of the plurality of abrading sheets configured to removably couple with each of the plurality of flexible substrates.

14. An abrading system for a hand power tool comprising:

a planar base substantially contained within a single plane, the at least one planar base having a first base end portion and a second base end portion and configured to couple with the output shaft of a hand power tool, the base defining a base length between a first coupler at the first base end portion and a first coupler at the base second end portion;

a flexible substrate having a first substrate end portion directly coupled with the first base end portion, a second substrate end portion directly coupled with the second base end portion, and a middle portion spaced apart from the base and extending between the first extending portion and the second extending portion, the flexible substrate defining a working length wherein the working length is greater than the base length; and an abrading material attached to the flexible substrate;

wherein the flexible substrate defines a continuous flexible member extending from the first substrate end portion to the second substrate end portion.

15. The abrading system of claim 14, wherein the flexible substrate is patterned to vary the flexibility of the substrate along the working length.

16. The abrading system of claim 14, wherein the middle portion of the flexible substrate is patterned to vary the flexibility of the substrate along the working length.

17. The abrading system of claim 14, wherein the first substrate end portion is removably coupled with the first base end portion and the second substrate end portion is removably coupled with the second base end portion.

* * * * *

UNITED STATES PATENT AND TRADEMARK OFFICE

CERTIFICATE OF CORRECTION

PATENT NO. : 8,210,909 B2
APPLICATION NO. : 12/079007
DATED : July 3, 2012
INVENTOR(S) : Bernardi et al.

It is certified that error appears in the above-identified patent and that said Letters Patent is hereby corrected as shown below:

On the Title page at (54) Title:

Replace "ABRADING SYSTEM" with --CONTOUR SANDING PAD--

Signed and Sealed this
Sixth Day of November, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,210,909 B2
APPLICATION NO. : 12/079007
DATED : July 3, 2012
INVENTOR(S) : Bernardi et al.

It is certified that error appears in the above-identified patent and that said Letters Patent is hereby corrected as shown below:

On the Title page at (54) and at Column 1, line 1, Title:

Replace "ABRADING SYSTEM" with --CONTOUR SANDING PAD--

This certificate supersedes the Certificate of Correction issued November 6, 2012.

Signed and Sealed this
Eleventh Day of December, 2012

David J. Kappos

David J. Kappos
*Director of the United States Patent and Trademark Office*